US007770256B1

(12) United States Patent
Fester

(10) Patent No.: US 7,770,256 B1
(45) Date of Patent: Aug. 10, 2010

(54) VACUUM CLEANER WITH MULTIPLE CYCLONIC DIRT SEPARATORS AND BOTTOM DISCHARGE DIRT CUP

(75) Inventor: Joseph A. Fester, Ada, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 1501 days.

(21) Appl. No.: 10/908,177

(22) Filed: Apr. 29, 2005

Related U.S. Application Data

(60) Provisional application No. 60/521,466, filed on Apr. 30, 2004.

(51) Int. Cl.
*A47L 9/10* (2006.01)

(52) U.S. Cl. ..... 15/353

(58) Field of Classification Search ..... 15/353, 15/320, 323, 346, 352, DIG. 8, 411, 363; 55/337, 345; *A47L 5/14, 9/20, 9/16; B01D 45/12*
See application file for complete search history.

(56) References Cited

U.S. PATENT DOCUMENTS

| | | | | |
|---|---|---|---|---|
| 3,425,192 | A | 2/1969 | Davis | |
| 6,238,451 | B1 | 5/2001 | Conrad et al. | |
| 6,334,234 | B1 | 1/2002 | Conrad et al. | |
| 6,344,064 | B1 | 2/2002 | Conrad | |
| 6,482,252 | B1 * | 11/2002 | Conrad et al. | 96/57 |
| 6,578,230 | B2 * | 6/2003 | Park et al. | 15/353 |
| 6,582,489 | B2 | 6/2003 | Conrad | |
| 6,607,572 | B2 | 8/2003 | Gammack et al. | |
| 6,607,575 | B2 | 8/2003 | Oh et al. | |
| 6,840,972 | B1 * | 1/2005 | Kim | 55/337 |
| 7,070,636 | B2 * | 7/2006 | McCormick et al. | 55/299 |
| 2001/0052166 | A1 * | 12/2001 | Park et al. | 15/353 |
| 2002/0062632 | A1 * | 5/2002 | Oh | 55/337 |
| 2002/0116907 | A1 * | 8/2002 | Gammack et al. | 55/345 |
| 2003/0014953 | A1 * | 1/2003 | Oh | 55/337 |
| 2003/0200734 | A1 | 10/2003 | Conrad | |
| 2003/0221277 | A1 * | 12/2003 | Oh et al. | 15/328 |
| 2004/0068827 | A1 | 4/2004 | Dyson | |
| 2004/0088956 | A1 | 5/2004 | Gammack | |
| 2004/0112018 | A1 | 6/2004 | Vuijk | |
| 2004/0144070 | A1 | 7/2004 | Gammack et al. | |

FOREIGN PATENT DOCUMENTS

| | | |
|---|---|---|
| EP | 0 885 585 A1 | 6/1997 |
| EP | 1 268 076 B1 | 3/2001 |
| GB | 2360719 A | 10/2003 |
| JP | 52014775 | 2/1977 |
| WO | WO 97/12660 | 4/1997 |

(Continued)

*Primary Examiner*—Joseph J Hail, III
*Assistant Examiner*—Jamal Daniel
(74) *Attorney, Agent, or Firm*—McGarry Bair PC

(57) ABSTRACT

A vacuum cleaner with a first cyclonic dirt separation and a secondary cyclonic dirt separation and a bottom dirt-collecting bin beneath the first cyclone separator and a filter beneath the dirt cup and between the dirt cup and a suction source inlet. The secondary cyclones oriented generally perpendicular to the first cyclone separator. A separator plate separates the cyclone separator from the dirt cup. Fins project from a sidewall of the dirt tank, and fingers projecting from a bottom wall of the dirt tank. A hollow standpipe in the dirt cup transports working air from the cyclone separator outlet to the filter.

21 Claims, 7 Drawing Sheets

FOREIGN PATENT DOCUMENTS

| | | | | |
|---|---|---|---|---|
| WO | WO 00/44272 | | | 8/2000 |
| WO | WO 0160226 | A1 | * | 8/2001 |
| WO | WO 01/74493 | A1 | | 10/2001 |
| WO | WO 01/95780 | A2 | | 12/2001 |
| WO | WO 02/067754 | A1 | | 9/2002 |
| WO | WO 02/067755 | A1 | | 9/2002 |
| WO | WO 02/067756 | A1 | | 9/2002 |
| WO | WO 02/067757 | A1 | | 9/2002 |
| WO | WO 02/082966 | A1 | | 10/2002 |
| WO | WO 03/068407 | A1 | | 8/2003 |

* cited by examiner

VACUUM CLEANER WITH MULTIPLE CYCLONIC DIRT SEPARATORS AND BOTTOM DISCHARGE DIRT CUP

CROSS REFERENCE TO RELATED APPLICATIONS

This application claims the benefit of U.S. Provisional Patent Application Ser. No. 60/521,466, filed Apr. 30, 2004, which application is incorporated herein by reference in its entirety.

FIELD OF THE INVENTION

The invention relates to suction cleaners, and in particular to suction cleaners having cyclonic dirt separation. In one of its aspects, the invention relates to a separator with a cyclonic airflow path to separate dirt and debris from air drawn into the cleaner. In another of its aspects, the invention relates to a separator that deposits the dirt and debris in a collection receptacle. In another of its aspects, the invention relates to a bottom discharge dirt cup with an integrated filter chamber. In another of its aspects, the invention relates to multiple cyclone separators including a single primary cyclone in series with a plurality of secondary cyclones arranged in parallel.

DESCRIPTION OF THE RELATED ART

Cyclone separators are well known. Some follow the textbook examples using frusto-conical shape separators and others use high-speed rotational motion of the air/dirt to separate the dirt by centrifugal force. Typically, working air enters and exits at an upper portion of the cyclone separator as the bottom portion of the cyclone separator is used to collect debris. Furthermore, in an effort to reduce weight, the motor/fan assembly that creates the working air flow is typically placed at the bottom of the handle, below the cyclone separator. This arrangement therefore, requires a tortuous air path from the top of the cyclone assembly, down the handle to the inlet of the motor/fan assembly. This creates a long air path with multiple parts which may allow for air leaks and generally negatively impacting airflow and, necessarily, cleaning performance.

Conrad et al., in U.S. Pat. No. 6,129,775 discloses a cyclone separator with at terminal insert which can take a number of forms. In FIG. 14(*d*), the terminal insert may comprise a plurality of longitudinally extending members (such as rods), which extend upwardly into the cyclone separator cavity from the bottom surface of the cyclone separator. The rods are said to interact with circulating fluid 48 to disrupt its rotational motion. The rods may be positioned symmetrically non-symmetrically around longitudinal axis of the separator. The rods may be a variety of shapes such as, in transverse section, squares, ellipses or other closed convex or abode shapes. Further, the transverse section of rods may vary longitudinally.

BISSELL Homecare, Inc. presently manufactures and sells in the United States an upright vacuum cleaner that has a cyclone separator and a dirt cup. A horizontal plate separates the cyclone separator from the dirt cup. The air flowing through the cyclone separator passes through an annular cylindrical cage with baffles and through a cylindrical filter before exiting the cyclone separator at the upper end thereof. The dirt cup has three finger-like projections extending upwardly from the bottom thereof to agglomerate the dirt in the dirt cup. The dirt cup further has a pair of radial fins extending inwardly from the side walls of the dirt cup. The dirt cup and the cyclone separator is further disclosed in the co-pending U.S. patent application Ser. No. 10/058,514, filed Jan. 28, 2002, which application is incorporated herein by reference.

U.S. Pat. No. 6,070,291 to Bair et al. and its progeny attempts to solve the efficiency problem by shortening the air path from the cyclone exhaust to the motor inlet. These patents disclose a pleated main filter element in a cyclonic chamber whereby exhaust air is drawn through the main filter through the bottom of the cyclonic chamber and directly into the motor/fan inlet. The motor/fan assembly is in a vertical position below the cyclone which is undesirable due to the amount of space needed at the bottom of the handle.

U.S. Pat. No. 6,341,404 to Salo et al. discloses a bottom discharge cyclone chamber with the motor/fan assembly mounted horizontally below the cyclone chamber. However, motor exhaust air is redirected back up towards the bottom of the cyclone chamber where it exits the unit in a radial fashion. This path introduces a number of turns which tends to create backpressure and therefore reduce efficiency.

U.S. Pat. No. 6,607,572 to Dyson discloses a cyclonic separating apparatus with upstream and downstream cyclonic units, wherein the downstream units comprise a plurality of cyclones inverted relative to the upstream cyclone and inverted with respect to the upstream cyclone. This arrangement of cyclones necessarily creates a tall unit because the downstream cyclones are located above the upstream cyclone.

The U.S. Pat. No. 3,425,192 to Davis discloses a vacuum cleaner dirt separator that has a primary cyclone separator and a plurality of parallel secondary cyclones.

SUMMARY OF THE INVENTION

According to the invention, a vacuum cleaner comprises a housing defining a first cyclonic airflow chamber for separating contaminants from a dirt-containing air stream as it travels around a cyclonic axis in the first cyclonic airflow chamber, a cyclonic chamber inlet and an air stream outlet in fluid communication with the cyclonic airflow chamber. The vacuum cleaner includes a nozzle housing having a suction opening fluidly connected with the cyclonic chamber inlet, and an airstream suction source fluidly connected to the main suction opening and to the cyclonic airflow chamber for transporting dirt-containing air from the suction opening to the cyclonic airflow chamber. The suction source is adapted to establish and maintain a dirt-containing airstream from the suction opening to the cyclonic chamber inlet. A dirt-collecting bin is mounted to the housing beneath the first cyclonic airflow chamber and includes a bottom wall, a cylindrical sidewall, and an open top. At least one secondary cyclone has an inlet opening in fluid communication with the first cyclonic airflow chamber outlet. According to the invention, the at least one secondary cyclone has a cyclonic axis that is oriented substantially perpendicular to the cyclonic axis of the first cyclonic airflow chamber.

The number of secondary cyclone separators can vary over a wide range, depending on the relative size and the degree of separation desired. Typically, the number of the secondary cyclones will be in excess of one and not more that 16. Multiple secondary cyclones are arranged in parallel downstream from the first cyclonic airflow chamber and can be arranged in an equi-angular fashion perpendicular to a cyclonic axis of the primary cyclonic airflow chamber.

The at least one and each of the secondary cyclones have a debris outlet that is in communication with a secondary debris collector that is preferably mounted within the dirt-collecting bin. The secondary debris collector of the preferred embodiment has a frustoconical shape and an open top. A removable lid covers the open top of the secondary debris collector and is preferably mounted to the housing, preferably through an annular wall that extends through the first cyclonic chamber.

In a preferred embodiment of the invention, a hollow standpipe extends centrally through the dirt-collecting bin, forming the airstream outlet for the housing. The at least one and each of the secondary cyclones have airstream outlets that communicate with the standpipe which also extends through the first cyclonic chamber. The annular wall surrounds the standpipe and defines, with the standpipe, a debris passage between the outlets of the one or more secondary cyclones and the secondary debris collector.

The dirt-collecting bin is separable from the first cyclonic chamber for emptying the contents of the dirt-collecting bin and the secondary debris collector at the same time.

Preferably, the vacuum cleaner further comprises a cylindrical baffle between the first cyclonic chamber and the inlet openings of the secondary cyclones. Further, a separator plate is mounted to the housing of the vacuum cleaner between the first cyclonic chamber and the dirt-collecting bin with an annular space between a side wall of the first cyclonic chamber and an outer edge of the separator plate for passage of debris separated from the airstream in the first cyclonic chamber to pass into the dirt-collecting bin.

A filter for filtering any particles not separated from the airstream in the first cyclonic chamber or the secondary cyclones is preferably placed downstream from the airstream outlet. The filter is further placed upstream of the airstream suction source and can be cylindrical in shape.

In a preferred embodiment, airflow inhibitors are present in the dirt-collecting bin to reduce the vertical component of the airflow, thereby tending to agglomerate and separate the dirt particles from the airflow.

In accordance with another embodiment of the invention, a vacuum cleaner comprises a housing defining a first cyclonic airflow chamber for separating contaminants from a dirt-containing air stream as it travels around a cyclonic axis in the first cyclonic airflow chamber, a cyclonic chamber inlet and an air stream outlet in fluid communication with the cyclonic airflow chamber. The vacuum cleaner includes a nozzle housing having a suction opening fluidly connected with the cyclonic chamber inlet, and an airstream suction source fluidly connected to the main suction opening and to the cyclonic airflow chamber for transporting dirt-containing air from the suction opening to the cyclonic airflow chamber. The suction source is adapted to establish and maintain a dirt-containing airstream from the suction opening to the cyclonic chamber inlet. A dirt-collecting bin is mounted to the housing beneath the first cyclonic airflow chamber and includes a bottom wall, a cylindrical sidewall, and an open top. At least one secondary cyclone has an inlet opening in fluid communication with the first cyclonic airflow chamber outlet and a debris outlet in communication with a secondary debris collector. According to the invention, the secondary debris collector is in the dirt-collecting bin and has an open top and the dirt-collecting bin is separable from the first cyclonic chamber for dumping of the dirt-collecting bin and the secondary debris collector at same time.

In a preferred embodiment, the open top is covered by a removable lid. The removable lid is preferably mounted to the housing, preferably though an annular wall that extends through the first cyclonic chamber.

In one embodiment, the flow inhibitors comprise at least one finger extending upwardly from the bottom wall of the dirt-collecting bin and positioned radially between a center of the dirt-collecting bin and the sidewall thereof. Preferably, the airflow inhibitors comprise a plurality of said fingers each positioned radially between a center of the dirt-collecting bin and the sidewall thereof. The fingers extend a portion of the distance between the bottom wall and the separator plate. Further, the fingers are rectangular in cross section with a long axis radially disposed in the dirt-collecting bin.

In another embodiment, the airflow inhibitors further comprise at least one fin that extends radially inwardly from the sidewall of the dirt-collecting bin. Preferably, there are two and only two fins. The fins are generally positioned vertically below the inlet. The fin or fins extend a portion of the distance between the bottom wall and the separator plate. The fin or fins extend between 40% and 60% of the distance between the bottom wall and the separator plate. Generally, the fins have a radial dimension between 2% and 10% of the radius of the dirt-collecting bin, preferably between 3% and 6% of the radius of the dirt-collecting bin. In a specific embodiment, the fins have a radial dimension equal to about 4% of the radius of the dirt-collecting bin.

DESCRIPTION OF THE PREFERRED EMBODIMENT

Figure 1:
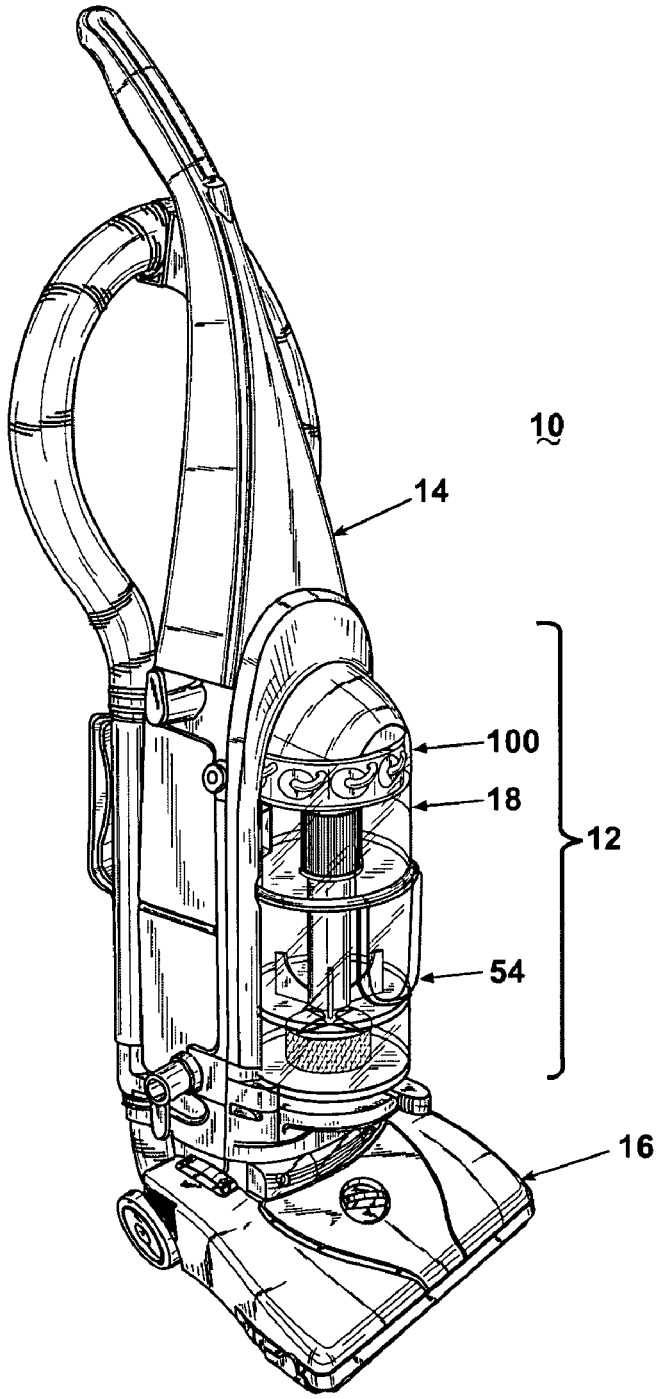
FIG. 1 is a perspective view of an upright vacuum cleaner with cyclone separator according to the invention.

An upright vacuum cleaner 10 with cyclonic dirt separator and dirt cup assembly 12 according to the invention is shown in FIG. 1, comprising an upright handle 14 pivotally mounted to a nozzle base 16. The upright handle 14 mounts the cyclonic dirt separator and dirt cup assembly 12 according to the invention.

Figure 2:
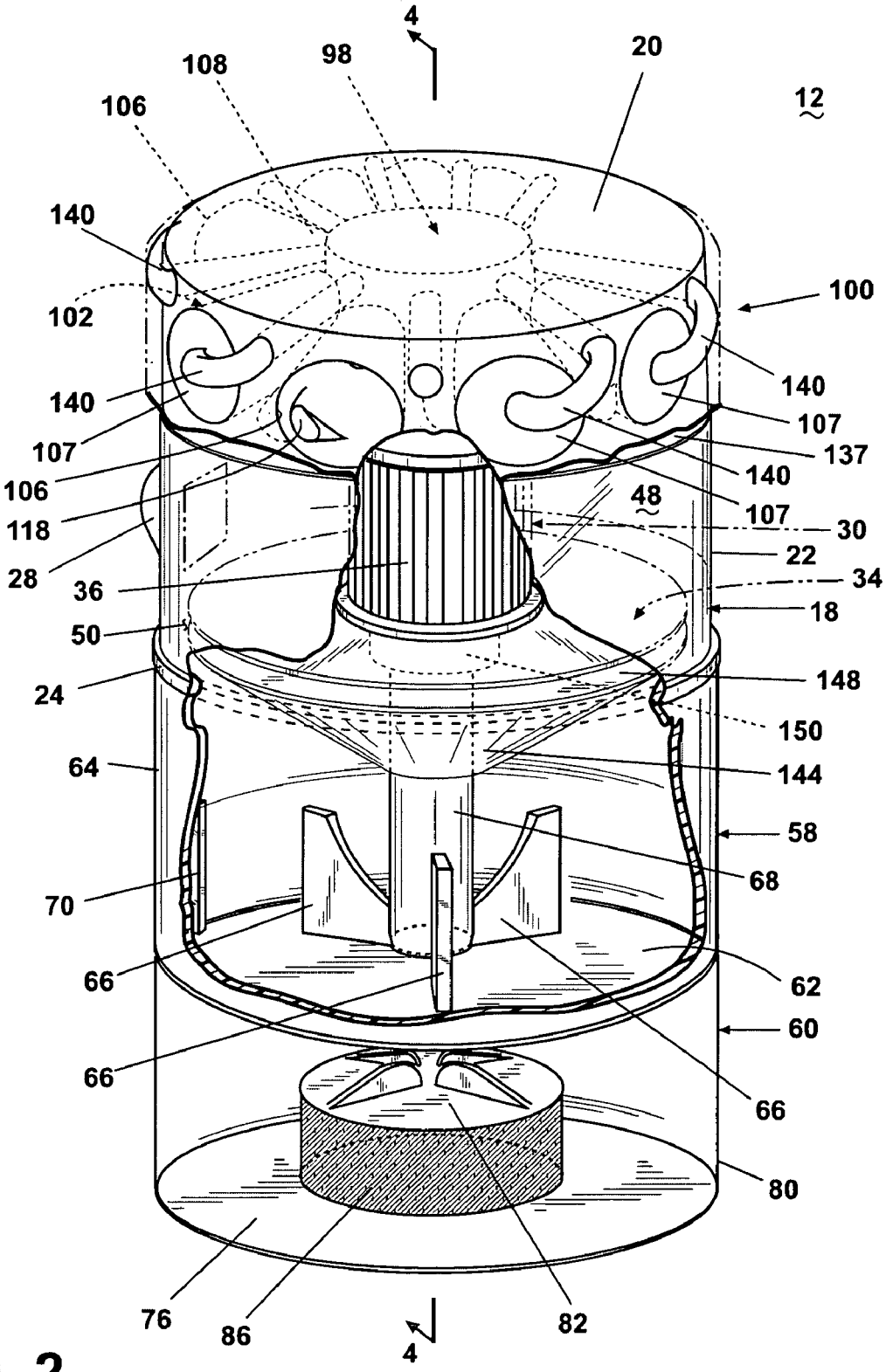
FIG. 2 is a cut-away perspective view of the cyclonic separator of FIG. 1.
Figure 3:
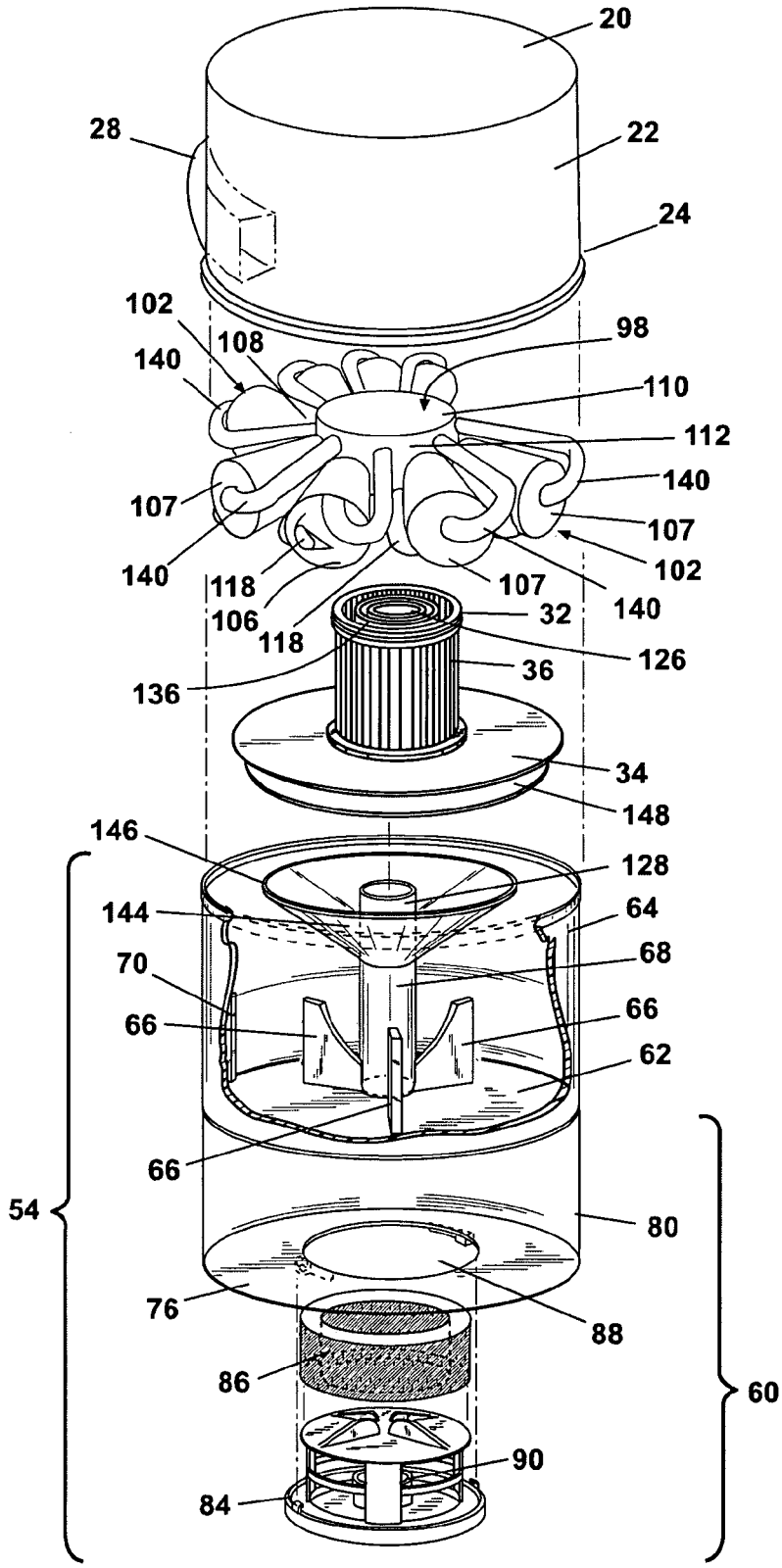
FIG. 3 is a cut-away exploded perspective view of the cyclonic separator of FIG. 1.
Figure 4:
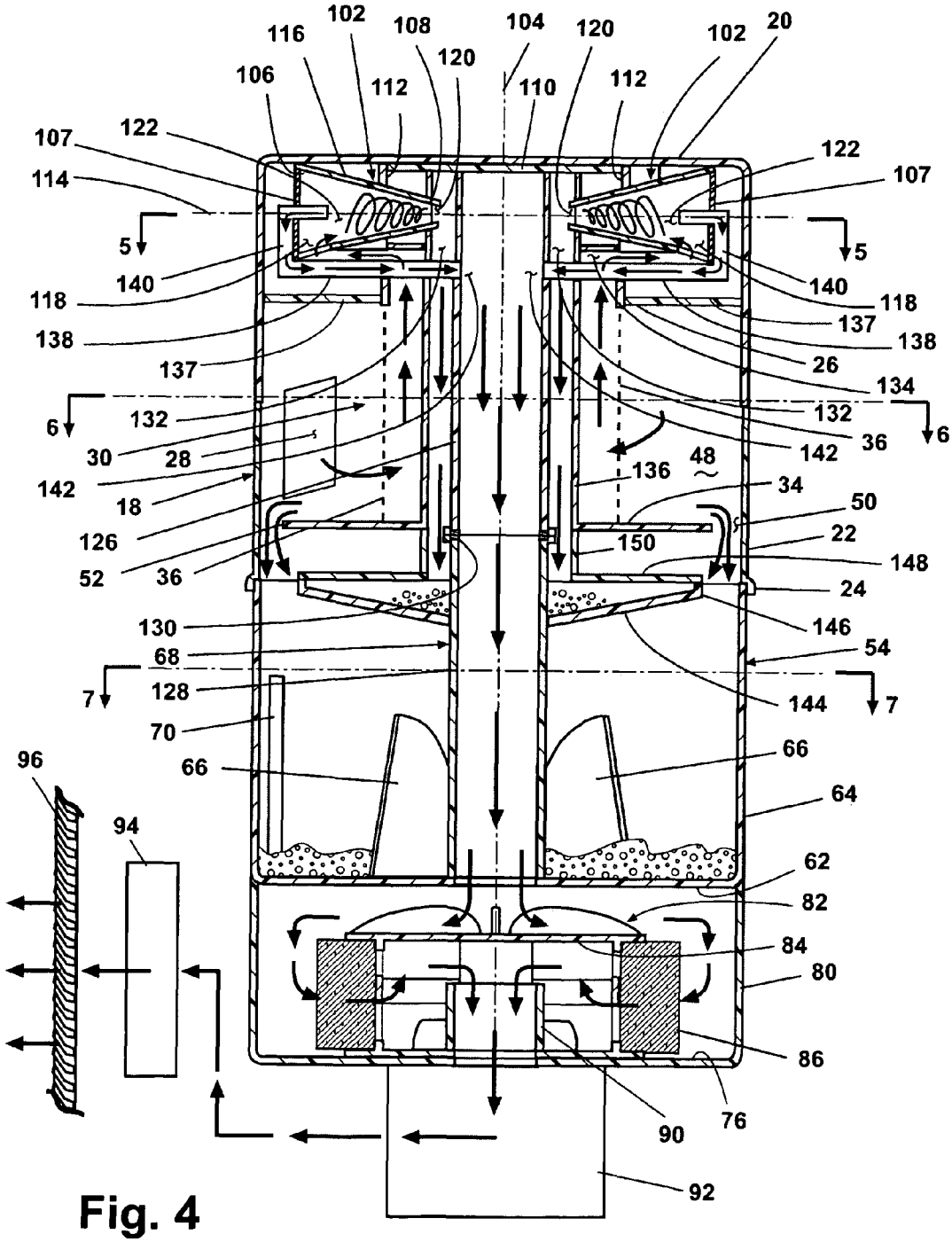
FIG. 4 is a cross-sectional view taken through line 4-4 of FIG. 2.

Referring to FIG. 2-4, the cyclonic dirt separator and dirt cup assembly 12 comprises a cylindrical cyclone separator 18 with an upper wall 20 and a sidewall 22, the sidewall 22 terminating in a lower offset lip 24. The sidewall 22 further includes a tangential air inlet 28 aligned proximate the upper wall 20 for generating a tangential airflow in the separator 18 parallel to the upper wall 20.

The cyclonic dirt separator 18 further comprises an exhaust assembly 30. The exhaust assembly 30 comprises a hollow cylindrical louver cage 32 mounted on a separator plate 34. The louver cage 32 further comprises a plurality of louvers 36 cylindrically arranged between a top portion of the louver cage 32 and the separator plate 34. An annular wall 136 in concentrically positioned within louver cage 32 and extends from separator plate 34 and is capped at an upper end by an upper annular wall 137. A working air path is defined between the louver cage 32 and annular wall 136 and through a centrally located aperture on the separator plate 34. The louver cage 32 and separator plate 34 are removably mounted on an annular collar 26 via a friction fit. However, other mechanical fastening means can be used to removably mount the exhaust assembly 30. For example, one quarter turn bayonet fasteners, ramped threads, detents, or any other commonly known fastening method can be used according to the invention.

A secondary cyclone assembly 100 is positioned above and in fluid communication with the exhaust assembly 30 of the cyclone separator 18. The secondary cyclone assembly 100 further comprises a plurality of secondary cyclones 102 spaced about a central vertical axis 104 of the exhaust assembly 30. Each secondary cyclone 102 is frusto-conical in shape with a larger end 106 located toward sidewall 22 and a smaller end 108 located toward a secondary cyclone inner wall 112. The inner wall 112 is capped by a top surface 110 wherein the wall 112 and top surface 110 define an inner plenum 98. The annular collar 26 that mounts the louver cage 32 extends downwardly from inner plenum 98. A longitudinal axis 114 of each secondary cyclone 102 is oriented generally perpendicular to the central vertical axis 104. In an alternate embodiment, the secondary cyclone 102 is concave, or bowed out, relative to the longitudinal axis.

Each secondary cyclone 102 comprises a cone 116, a working air inlet opening 118, a debris exhaust 120, and a working air outlet 122. The large ends 106 of the cones 116 are closed by an end cap 107. The working air outlet 122 is located along the longitudinal axis 114 at or near the larger end 106 and extends through the end cap 107 while the debris exhaust 120 is located at the smaller end 108, radially inward of the inlet opening 118 and in line with the longitudinal axis 114. The working air inlet opening 118 is an aperture formed in a side wall of the cone 116 near the larger end 106.

A first cyclonic chamber 48 is defined between the cylindrical arrangement of louvers 36 and the sidewall 22, and between secondary cyclone assembly 100 and the separator plate 34, respectively. In the preferred embodiment, the air inlet 28 is vertically aligned between the secondary cyclone assembly 100 and the separator plate 34 such that the tangential airflow generated from the tangential air inlet 28 is directed into the first cyclonic chamber 48.

The tangential airflow, containing particulate matter, passes through the tangential air inlet 28 and into the first cyclonic chamber 48 to travel around the exhaust assembly 30. As the airflow travels about the first cyclonic chamber 48, heavier dirt particles are forced toward the sidewall 22. These particles fall under the force of gravity through a gap 50 defined between an edge 52 of the separator plate 34 and the sidewall 22. Referring particularly to FIG. 4, dirt particles falling through the gap 50 drop through an open end of the separator 18 and are collected in a dirt cup and filter chamber assembly 54. The upper end of the dirt cup/filter chamber 54 is received in a nesting relationship in the lower offset lip 24 of the sidewall 22 to seal the cyclone separator 18 to the dirt cup/filter chamber 54. The dirt cup/filter chamber 54 thereby performs the function of collecting the dirt separated from the airflow within the cyclone separator 18.

The dirt cup/filter chamber 54 is removably connected to the housing 12. The dirt cup/filter chamber 54 is generally vertically adjustable relative to the cyclone separator 18, such as by a cam mechanism on a vacuum cleaner, so that it can be raised into an engaged and operative position underneath the cyclone separator 18. The upper edge of sidewall 64 is received within offset lip 24, which prevents the dirt cup/filter chamber 54 from being dislodged from the cyclone separator 18.

The dirt cup/filter chamber 54 comprises a pair of vertically oriented regions. The upper region comprises a dirt-collecting bin 58 for collecting dirt as previously described and the lower chamber region comprises a filter chamber 60. The dirt-collecting bin 58 is formed with a generally planar dirt cup bottom wall 62 and an upstanding cylindrical dirt cup sidewall 64 to form an open-topped receptacle. A plurality of upstanding prongs or fingers 66 project upwardly from the bottom wall 62. The fingers 66 can function in varying arrangements, but in the preferred embodiment the fingers 66 are arranged generally symmetrically about a hollow standpipe 68 concentric with sidewall 64. The fingers 66 are found to function best when displaced at least some distance from an outer wall of the standpipe 68. Each of the fingers 66 are shown as being generally rectangular in plan view, having a long axis of its plan cross-section aligned with a radius of the circle. The fingers 66 can be of uniform cross-section from top to bottom, or can have a tapering cross-section as depicted in FIG. 4, wherein the fingers 66 are narrower at the top and wider at the base where they join the bottom wall 62. The fingers 66 are approximately three quarters the height of the dirt-collecting bin 58. Increasing the height of the fingers 66 is preferred, but can be limited by production and tooling constraints and, as will be further described, also by the need to be able to detach the dirt cup/filter chamber 54 from the cyclone separator 18. In an alternate embodiment, the fingers 66 can be attached to an outer surface of the standpipe 68 and extend outward therefrom terminating at some distance from the outer side wall 64.

The filter chamber region 60 further comprises a bottom wall 76 in spaced relation to the dirt cup bottom wall 62 and with a side wall 80. The bottom wall 62 further comprises a centrally located aperture that is in fluid communication with a bottom portion of the standpipe 68. The bottom wall 76 further comprises an aperture 88 to removably receive a filter assembly 82. The filter assembly 82 further comprises a filter cage 84 which supports a cylindrical foam filter 86. The filter assembly mates with the bottom wall 76 via a ¼ turn bayonet fastener or any other suitable mechanical fastening means as previously described. As can be appreciated, air flow enters the filter chamber region 60 from aperture in bottom wall 62, passes through the foam filter 86 where particulate matter is captured, and continues on through an inlet 90 to a suction source 92 where the air is exhausted to the atmosphere though an open grid 96. In an alternate embodiment, the filter is a flat foam filter. Optionally, the suction source exhaust air may pass through a final filter 94 before re-entering the atmosphere through grid 96.

Referring particularly to FIG. 4, the standpipe 68 extends upwardly from bottom wall 26 along the vertical axis 104 through the exhaust assembly 30 and is sealingly terminated at top surface 110. The standpipe 68 is formed in two parts, an upper standpipe 126 and a lower standpipe 128 which together define an inner exhaust chamber 142 that extends substantially the length of the cyclone separator 18. The upper standpipe 126 is fixed to the upper wall 20 while the lower standpipe 128 is fixed to the dirt cup bottom wall 62. Sealing communication between the upper and lower standpipes 126, 128 is maintained by a gasket 130 therebetween. A generally cylindrical secondary debris chamber 132 is oriented along the vertical axis 114 and is formed between the inner wall 112 and an outer surface of the standpipe 68. A generally cylindrical working air plenum 134 is also oriented along the vertical axis 114 and is formed between the annular wall 136, wall 112 and the upper annular wall 137.

Figure 5:
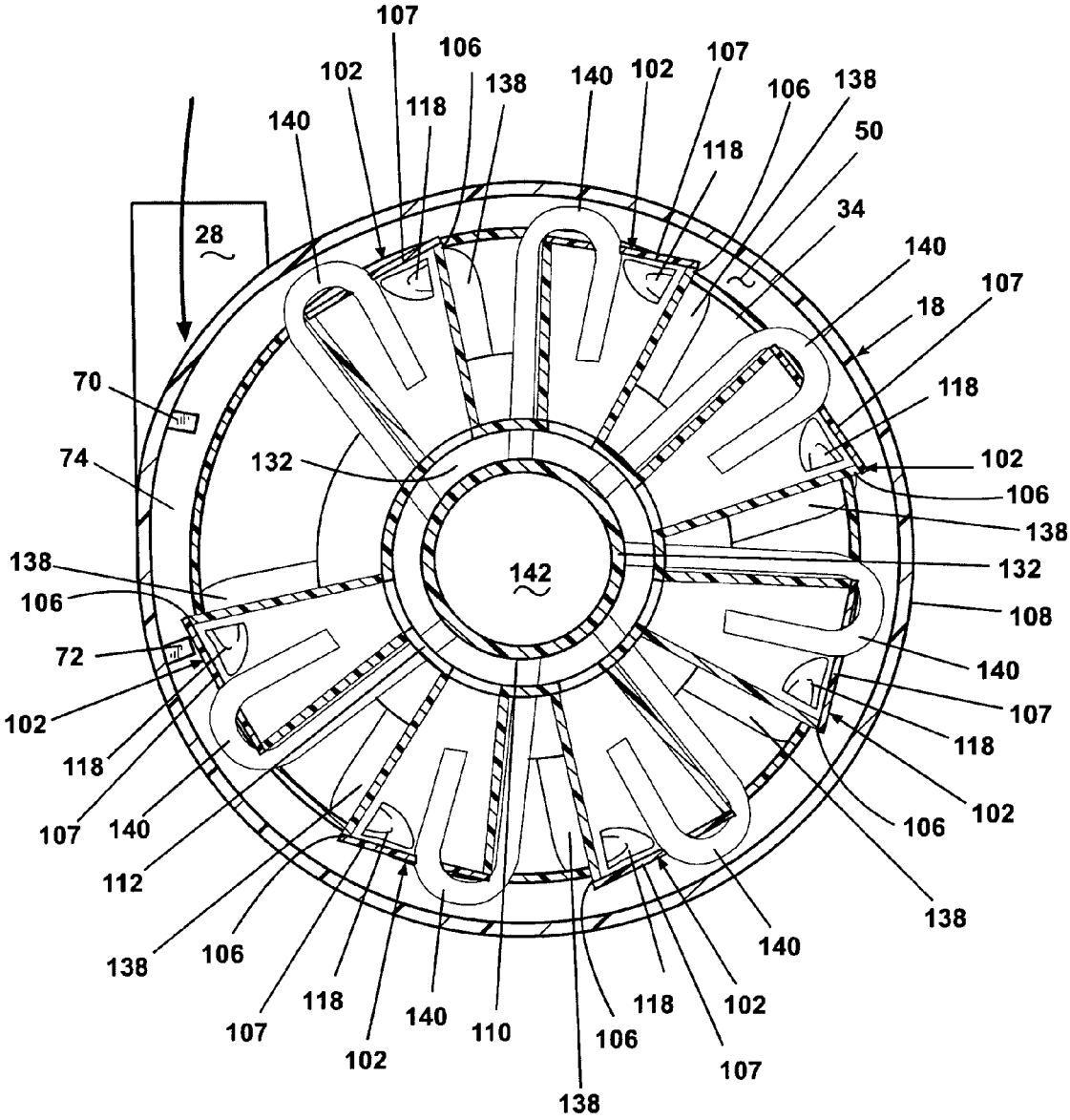
FIG. 5 is a cross sectional view taken through line 5-5 of FIG. 4.

Referring to FIGS. 4 and 5, the standpipe 68, the secondary debris chamber 132, the working air plenum 134 and the outer wall 108 of the secondary cyclone assembly 100 are aligned concentrically about the vertical axis 104. The secondary debris chamber 132 is an annular conduit that terminates below the separator plate 34. A secondary debris collector 144 is formed from in a frusto-conical shape and is attached at an inner end to the lower standpipe 128 and terminates in an upwardly directed lip 146 at an outer end. A removable lid 148 is positioned on the collector 144 and is sealed and secured at an inner annular edge to the bottom end of annular wall 136 with an upstanding annular collar 150. A working air inlet conduit 138 is in fluid communication between the working air plenum 134 and the working air inlet opening 118. A working air outlet conduit 140 is in fluid communication between an interior of the cone 116 near the larger end 106 and an interior surface, or exhaust chamber 142, of the upper standpipe 126.

The size and shape of the secondary cyclones 102 is important for maximizing separation efficiency. The relationship that various cyclone geometries have on separation efficiencies is disclosed in "Separation of Particles from Air and Gasses: Volume II" by Akria Ogawa, copyright date 1984 and published by CRC Press, Inc. Boca Raton, Fla. (pp. 1-49), which is incorporated herein by reference. In the preferred embodiment, the larger end 106 of the cone 116 has an opening that is 10 times the surface area of the smaller end 108. However, acceptable performance is obtained within a range of ratios of the larger end to the smaller end of about 2 to 1 to about 20 to 1, preferably between about 3.5 to 1 to about 8.5 to 1. Furthermore, the number of secondary cyclones 102 utilized in the secondary cyclone assembly 100 impacts the overall separation efficiency. In the preferred embodiment, seven secondary cyclones are arranged generally equi-angularly about the vertical axis 104, however, spacing between some of the secondary cyclones 102 can vary to provide space for the work air conduits 138, 140. The number of secondary cyclones 102 utilized can, however, vary between two and sixteen and preferably between four and ten.

Figure 6:
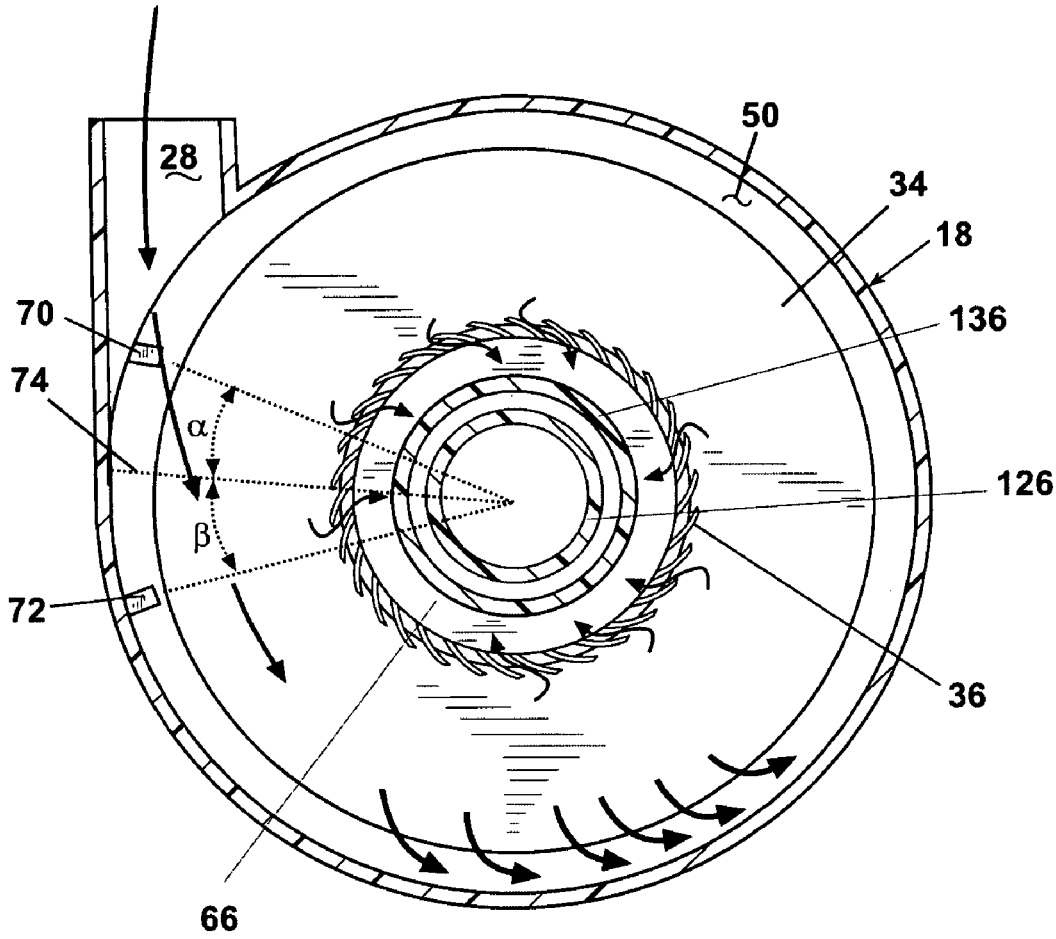
FIG. 6 is a cross-sectional view taken through line 6-6 of FIG. 4.
Figure 7:
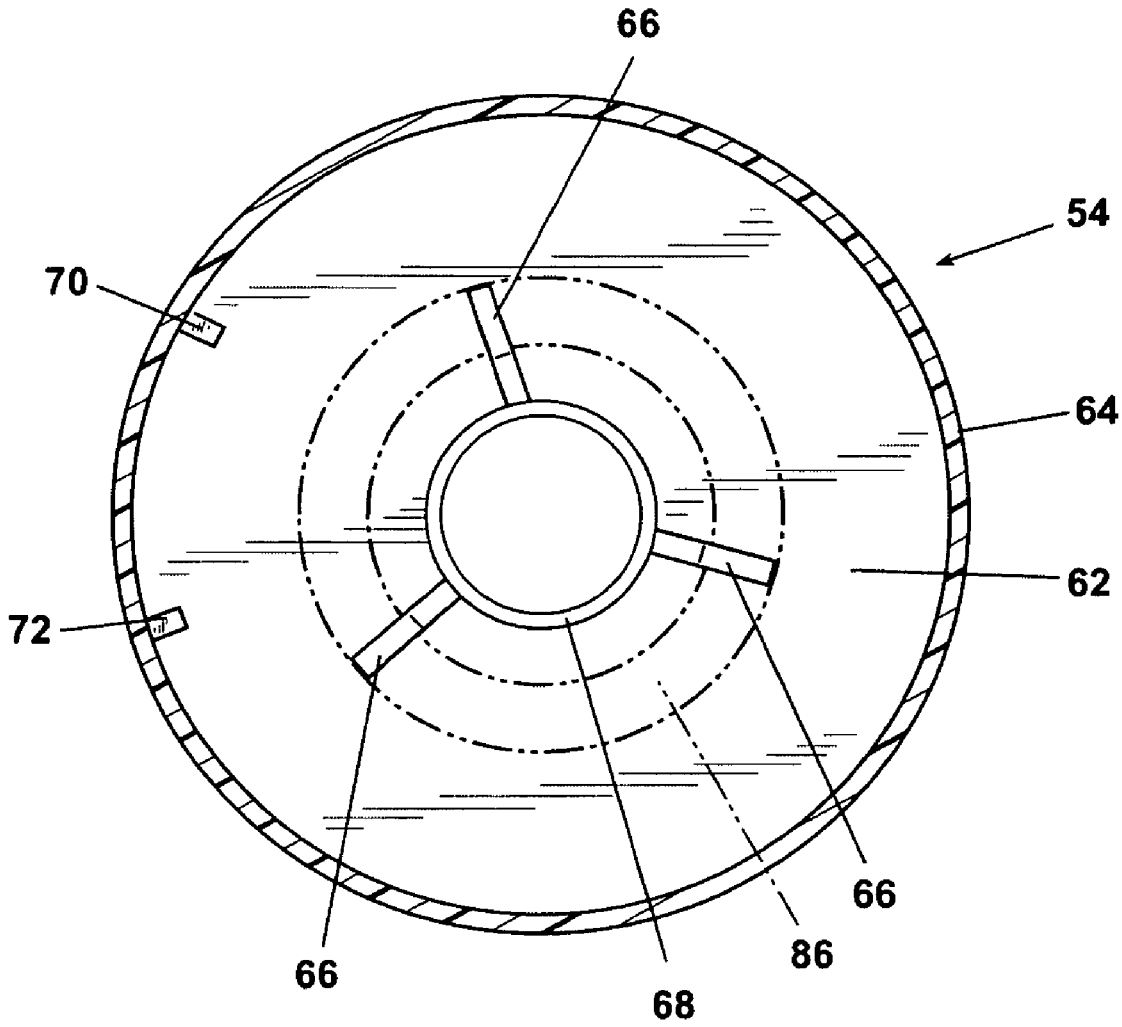
FIG. 7 is a cross-sectional view taken through line 7-7 of FIG. 4.

Referring to FIGS. 6 and 7, the dirt-collecting bin 58 includes a pair of fins 70, 72 affixed to and contiguous with the sidewall 64. The fins 70, 72 are generally rectangular in cross-section, in plan view, projecting inwardly from the sidewall 64 toward a center of the dirt-collecting bin 58. The distance the fins 70, 72 project from sidewall 64 can range from 2 to 10% of the radius, but is preferably 3 to 6% of the radius, and optimally 4% of the radius of the dirt-collecting bin 58. The fins 70, 72 extend generally upwardly from the bottom wall 62 of the dirt-collecting bin 58. In the preferred embodiment, the fins 70, 72 are perpendicular to the bottom wall 62 and extend approximately one-half of the height of the dirt-collecting bin 58, although the fins 70, 72 can vary in height from 40 to 60% of the distance from the bottom wall 62 to the separator plate 34 and still be effective. Also in the preferred embodiment, the fins 70, 72 are generally aligned in the direction of inlet airflow entering the cyclone separator 18 through the air inlet 28. The fins 70, 72 are arranged with respect to a radial plane 74 perpendicular to the tangential line that is in alignment with the inlet 28, with fin 70 angularly displaced from radial 74 by angle $\alpha$ and fin 72 displaced from radial 74 by angle $\beta$. These angles can vary over a range of about 30° to 60°, and preferably in the range of 40° to 50°. It has been found that a satisfactory placement of the fins results when the angle $\alpha$ is about 45° and the angle $\beta$ is about 45°.

As the inlet air traverses through first cyclonic chamber 48, casting dirt particles toward sidewall 22, the inlet air is drawn inwardly between the louvers 36. As seen in FIG. 6, the louvers 36 are oriented away from the direction of air flow (indicated by arrows) about the first cyclonic chamber 48. The velocity of the air flow is altered as the air flow changes direction to pass around and between the louvers 36. This change in velocity of the air flow causes additional dirt particles to separate from the air stream. These dirt particles are urged toward the gap 50 by the circulating air flow in the cyclone separator 18.

A known phenomenon in cyclone separators is the re-entrainment of dirt into the cyclonic airflow after it is apparently deposited in a dirt containment vessel positioned beneath the cyclone chamber. It has been discovered that this re-entrainment is due to the vertical component of air circulation within the dirt cup between the gap 50 at one side of the dirt-collecting bin 58 and the bottom wall 62 at an opposite side of the dirt-collecting bin 58. Generally, the airflow pattern has the strongest component at the bottom portion of the dirt-collecting bin 58 below the inlet 28 to the cyclone chamber 18. This air circulation is shown in phantom lines in FIG. 4.

These vertical components of the air circulation are manifested in the "vacillating" of the dirt deposited within the dirt-collecting bin 58. Disruption of, or a decrease in the magnitude of, these vertical components or vectors serves to minimize the re-entrainment of dirt in the cyclonic airflow and agglomeration of the dirt in the dirt cup. Disruption of the airflow tends to agglomerate the dirt particles in the dirt-collecting bin 58, forming clumps or balls unlikely to be re-entrained. It has been found that the fingers 66 and the fins 70, 72 function in concert to inhibit the vacillation of the debris deposited in the dirt-collecting bin 58, disrupting the elliptical vectors that generate upward currents that would tend to carry the smaller dirt particles upwardly and back into the cyclonic air flow. The fingers 66 further deflect dirt particles within the dirt-collecting bin 58 to further encourage agglomeration of the dirt particles. The fingers 70, 72 are generally arranged symmetrically about the dirt-collecting bin 58, but have been found to cooperate with the fins 70, 72 optimally when none of the fingers 66 are directly aligned with either of the fins 70, 72. path of air flow through the cyclonic dirt separator and dirt cup assembly 12 is illustrated by arrows in FIG. 4 and will now be described. Inlet air is drawn through the tangential air inlet 28 and traverses around the first cyclonic chamber 48 casting dirt particles toward the sidewall 22 thereby separating larger primary debris from the air stream and depositing the primary debris, by force of gravity, through the gap 50 between the separator plate edge 52 and the dirt cup side wall 64. Working air passes through the louvers 36 and into the working air plenum 134. Since the plurality of secondary cyclones 102 are arranged in parallel, working air is evenly divided to each working air inlet conduit 138. Working air then tangentially enters the cone 116 near the larger end 106 to create a swirling action within in the cone 116. As the swirling air approaches the smaller end 110 of the cone 116, the velocity of the air speeds up and throws the fine secondary debris remaining in the air stream toward the inner wall of the cone in a fashion similar to the primary cyclone separator 18. The fine secondary debris exits the interior of the cone 116 at the debris exhaust 120 and enters the collective secondary debris chamber 132 where it falls, under force of gravity, into the secondary debris collection container 144 located in the dirt-collecting bin 58.

The working air is then forced to change direction and enters the working air outlet 122 at the larger end 106 of the cone 116. Working air passes through the working air outlet conduit 140 and enters the collective exhaust chamber 140 within the upper standpipe 126 where it is drawn through exhaust chamber 142 to the filter chamber region 60. The working air passed though filter 86 where particulate matter is captured and continues through the suction source inlet 90. Optionally, the working air may pass through a final filter 94 before re-entering the atmosphere through grid 96.

To remove the dirt cup/filter chamber 54 from the cyclone separator 18, such as to discard accumulated dirt, the dirt cup/filter chamber 54 is displaced downwardly from the cyclone separator 18. Once disengaged from the offset lip 24, the dirt cup/filter chamber 54 can be removed from the separator 18. Lid 148 is removed from the secondary debris collection chamber 144 so that the entire content of the dirt can be emptied at the same time.

While the invention has been specifically described in connection with certain specific embodiments thereof, it is to be understood that this is by way of illustration and not of limitation. Reasonable variation and modification are possible within the forgoing disclosure and drawings without departing from the spirit of the invention which is defined in the appended claims.

What is claimed is:

1. A vacuum cleaner comprising:

a housing defining a first cyclonic airflow chamber for separating contaminants from a dirt-containing airstream as it travels about a first cyclonic axis in the first cyclonic airflow chamber, said housing further comprising a cyclonic chamber inlet and an airstream outlet in fluid communication with said cyclonic airflow chamber;

a nozzle housing including a suction opening, said suction opening being fluidly connected with said cyclonic chamber inlet;

an airstream suction source fluidly connected to said suction opening and to the first cyclonic airflow chamber for transporting dirt-containing air from the suction opening to the cyclonic airflow chamber, said suction source is adapted to establish and maintain a dirt-containing airstream from said suction opening through said first cyclonic airflow chamber inlet and to a first cyclonic airflow chamber outlet;

a dirt-collecting bin mounted to the housing beneath said first cyclonic airflow chamber, the dirt-collecting bin comprising a bottom wall, a sidewall, and an open top;

a plurality of secondary cyclones arranged around the first cyclonic axis, wherein each secondary cyclone comprises:

an inlet opening in fluid communication with the first cyclonic airflow chamber outlet;

a debris outlet positioned radially inward of the inlet opening; and a second cyclonic axis that is oriented substantially perpendicular to the first cyclonic axis; and a secondary debris collector in communication with the debris outlets of the secondary cyclones.

2. A vacuum cleaner according to claim 1, and further comprising a centrally located hollow standpipe that extends through the dirt-collecting bin and that forms the airstream outlet, wherein the secondary debris collector is mounted to the standpipe.

3. A vacuum cleaner according to claim 2 wherein each secondary cyclone has an outlet opening in communication with the standpipe.

4. A vacuum cleaner according to claim 3 wherein the standpipe also extends through the first cyclonic chamber.

5. A vacuum cleaner according to claim 4 wherein an annular wall surrounds the standpipe and extends through first cyclonic chamber to define, with the standpipe, a debris passage between the debris outlets of the secondary cyclones and the secondary debris collector.

6. A vacuum cleaner according to claim 2 wherein the secondary debris collector has a frustoconical shape.

7. A vacuum cleaner according to claim 2 and further comprising a cylindrical baffle between the first cyclonic chamber and the inlet openings of the secondary cyclones.

8. A vacuum cleaner according to claim 2 and further comprising a separator plate mounted to the housing between first cyclonic chamber and the dirt-collecting bin with an annular space between a side wall of first cyclonic chamber and an outer edge of separator plate for passage of debris separated from the airstream in the first cyclonic chamber.

9. A vacuum cleaner according to claim 2 and further comprising a filter downstream from the airstream outlet.

10. A vacuum cleaner according to claim 9 wherein the filter is upstream of the airstream suction source.

11. A vacuum cleaner according to claim 9 wherein the filter is cylindrical.

12. A vacuum cleaner according to claim 9 wherein the dirt-collecting bin is removable from the first cyclonic chamber, and the filter is removable with dirt-collecting bin.

13. A vacuum cleaner according to claim 1 wherein there are between four and sixteen secondary cyclones.

14. A vacuum cleaner according to claim 1 wherein the secondary debris collector is in the dirt-collecting bin.

15. A vacuum cleaner according to claim 1 wherein the secondary debris collector has an open top.

16. A vacuum cleaner according to claim 15 wherein the dirt-collecting bin is separable from the first cyclonic chamber for dumping of the dirt-collecting bin and the secondary debris collector at the same time.

17. A vacuum cleaner according to claim 16 wherein the open top is covered by a removable lid.

18. A vacuum cleaner according to claim 17 wherein the removable lid is mounted to the housing.

19. A vacuum cleaner according to claim 18 wherein the removable lid is mounted to an annular wall that is mounted to the housing and extends through the first cyclonic chamber.

20. A vacuum cleaner according to claim 1 wherein the secondary cyclones are frusto-conical in shape.

21. A vacuum cleaner according to claim 1 wherein the secondary debris collector has a frustoconical shape.

* * * * *